United States Patent [19]
Köhler et al.
[11] 4,282,137
[45] Aug. 4, 1981

[54] PROCESS FOR THE PRODUCTION OF POLYESTER FIBERS AND FILAMENTS WHICH CAN BE DYED IN THE ABSENCE OF CARRIERS AND THE FILAMENTS AND FIBERS PRODUCED THEREBY

[75] Inventors: Armin Köhler, Dormagen; Peter Hoffmann, Leverkusen; Herbert Pelousek; Eduard Specht, both of Dormagen, Fed. Rep. of Germany

[73] Assignee: Bayer Aktiengesellschaft, Leverkusen, Fed. Rep. of Germany

[21] Appl. No.: 904,816

[22] Filed: May 11, 1978

[30] Foreign Application Priority Data

May 14, 1977 [DE] Fed. Rep. of Germany ..... 2721984

[51] Int. Cl.[3] ..... C08K 67/00; D01F 1/04
[52] U.S. Cl. ..... 260/40 P; 8/489; 8/494; 264/78; 264/176 F; 264/211; 521/76
[58] Field of Search ..... 264/41, 78, 211, 176 F, 264/290 T; 260/40 P; 428/376–398; 8/179; 521/76

[56] References Cited

U.S. PATENT DOCUMENTS

| | | | |
|---|---|---|---|
| 2,956,329 | 10/1960 | Touey | 264/211 |
| 3,233,019 | 2/1966 | Adams | 264/290 T |
| 3,366,597 | 1/1968 | Fort | 260/40 P |
| 3,846,523 | 11/1974 | Geerdes | 264/DIG. 17 |
| 3,964,314 | 7/1976 | Grigull | 260/42 |
| 4,001,367 | 1/1977 | Guthrie et al. | 264/290 T |

*Primary Examiner*—Jay H. Woo
*Attorney, Agent, or Firm*—Sprung, Felfe, Horn, Lynch & Kramer

[57] ABSTRACT

The invention relates to polyester filaments and fibers and a process for the production of such polyester filaments and fibers which can be dyed in the absence of a carrier which comprises introducing into the polymer to be spun a silicate charged with an inert gas melt, spinning the mixture obtained in known manner and further processing into filaments or fibers.

6 Claims, No Drawings

PROCESS FOR THE PRODUCTION OF POLYESTER FIBERS AND FILAMENTS WHICH CAN BE DYED IN THE ABSENCE OF CARRIERS AND THE FILAMENTS AND FIBERS PRODUCED THEREBY

This invention relates to a process for the production of polyester fibres and filaments which can be dyed in the absence of carriers.

It is known that polyester fibres are difficult to dye. Accordingly, the following methods have been adopted for dyeing:

1. the carrier dyeing method which is carried out at boiling temperature; or 2. the high temperature (HT) dyeing method which is carried out at a temperature of from 120° C. to 135° C. for polyester fibres and their blends with cellulose fibres and at a temperature of from 104° C. to 106° C. for polyester fibre/wool blends.

It has now been found that polyester fibres and filaments which contain vacuoles and which are capable, therefore, of being dyed more easily and deeply in the absence of carriers, can be produced by a process in which a silicate charged with an inert gas is introduced into the polymer to be spun, followed by spinning.

Accordingly, the present invention provides a process for the production of polyester filaments and fibres which are capable of being dyed in the absence of carriers, characterised in that from 0.1 to 4.0% by weight, based on the total polymer mixture, of a silicate charged with an inert gas are introduced into the polymer to be spun and the resulting mixture is melt-spun in conventional manner and further processed into filaments or fibres.

It is known that various silicates have a three-dimensional network structure of attached silica tetrahedrons such that the mineral is permeated by channels with diameters of from about 5 Å to 6 Å. Of such silicates, particular reference is made to the zeolites, for example of the chabasite and analcite type, and to the glauconites (cf. F. Cramer "Einschlussverbindugen", Springer Verlag, Berlin Gottingen-Heidelberg, 1954, 556). The channels or vacuoles are preferably filled with water which may however be temporarily replaced by gases.

In order to charge the silicate with a gas, the silicate is dried for several hours at a temperature of 290° C. under a pressure of <1 Torr. The gas is then admitted under a slight excess pressure, followed by cooling.

According to the present invention, the gas used is an inert gas, i.e. a gas which is extremely sluggish in reaction and which above all is unable to damage the polyester melt. Gases which satisfy these requirements are, preferably, the noble gases and also nitrogen and carbon dioxide.

For the purposes of the present invention, the silicates are finely ground and, up to a level of 99.5%, have a grain size of less than 4 μm so that they do not give rise to any problems during spinning of the melt, sieve diameters of around 5 μm normally being used.

The silicates charged with inert gas are introduced into the polymer by methods known per se for example, either by adding the requisite quantity of silicate during the actual production of the polyester or by sintering the silicate onto the polymer granulate to be spun.

The hot polyester melt containing the silicate charged with inert gas is under high pressure during melt spinning in an extruder. When the melt emerges from the spinning jet, the inert gas escapes from the silicate and the still molten filaments. This results in the formation of vacuoles in the polyester filaments or fibres which have an average diameter of from 0.05 to 0.5 μm, are about 1.0 to 7.0 μm long and are preferably oriented in the longitudinal direction of the filament or fibre.

The filaments and fibres produced from the polyesters by the melt spinning process are further processed in known manner, namely bundled, drawn in hot water or another medium, fixed in hot air, crimped and cut. Fibres such as these have on average a strength of 2.5 to 4.5 cm/dtex, an elongation of from 20% to 50% and a boiling-induced shrinkage of from 0 to 3%. Textiles with excellent wear properties, such as high crease resistance, high strength and high scuffing resistance, can be produced from them, as is generally the case with polyester fibres.

Dyeing tests show that it is possible by the process according to the invention in which the silicate is added in quantities of from 0.1 to 4.0% by weight and preferably in quantities of from 0.3 to 1.0% by weight, to obtain fibres which can be dyed as deeply and as quickly in the absence of a carrier as fibres of the corresponding silicate-free polyester can be dyed in the presence of a carrier.

For the comparison measurements, dyeing was carried out by the following methods (cf. H. Ludewig "polyesterfasern", Akademie Verlag Berlin, 1965, page 346).

Method 1

The fibres were thoroughly washed before dyeing. The liquor ratio amounted to 1:20. Where a carrier was used for dyeing, 4 g/l of a standard commercial-grade carrier were added to the liquor. A pH-value of from 4.5 to 5.5 was then adjusted by the addition of monosodium phosphate and acetic acid. 2% of the disperse dye:

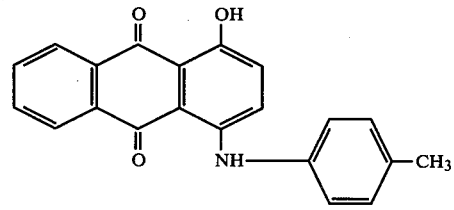

were then added to the liquor and the pH-value was readjusted if necessary. The dye bath was then heated to 80° C.–85° C. over 20 minutes and maintained at that temperature for from 15 to 20 minutes. The carrier developed its swelling effect during this residence time. The bath was then heated to boiling temperature over a period of 30 minutes and left at that temperature for 1 hour. On completion of dyeing, the dyed material was warm-rinsed and then dried.

Method 2

For carrier-free dyeing, dyeing was carried out by the same process as described above, except that no carrier was added to the liquor.

For closer verification of these tests, the colour velency was determined. The colour valency consists of three colour values and clearly defines a colour. The reference system is the internationally agreed CIE System which is equivalent to the Standard Valency System according to DIN 5033. Under the CIE System, the colour values are designated X, Y and Z. For measurement, the fibres were pressed into a round cuvette. The three-range colour measuring process was then carried out with a filter photometer of the ELREPHO type manufactured by the Carl Zeiss company of Oberkochen. In this process, the degree of remission of the sample is measured with three special colour measuring filters and the colour values X, Y and Z are calculated simply from the remission values $R_x$, $R_y$ and $R_z$ in accordance with the following formulae:

For standard light type C $$X=0.782\cdot R_x+0.198\cdot R_z$$

$$Y=R_y$$

$$Z=1.181\cdot R_z.$$

EXAMPLE 1

A finely ground silicate of the zeolite type, of which 99.5% had a grain size of less than 4 μm, was dried for 5 hours under a pressure of 0.02 Torr and at a temperature of 290° C. After venting to normal pressure, dry nitrogen was passed over the powder under a slight excess pressure. The silicate took up 8% by weight of nitrogen.

1% by weight of the silicate was sintered onto polyethylene terephthalate granulate in 15 minutes at a vessel temperature of 150° C. and at a stirrer speed of 1000 rpm. The granulate was delivered to an extruder and processed by known methods at a spinning temperature of 290° C., and at a take-off rate of 1000 meters per minute into fibres having the following properties:

denier: 3 dtex
strength: 4.0 cN/dtex
elongation: 30%.

In order to determine their dyeability, the fibres were dyed with the dispersion dye indicated above by the dyeing method described above (method 2, no carrier). On completion of dyeing, the fibres were deep blue in colour. The staple fibres were pressed into the cuvette and the three-range colouring measuring process described above was carried out.

The colour values observed were as follows:

$X=14.8$ $Y=12.7$ $Z=31.3.$

The entire process by which the fibres were produced was carried out with zeolite-free polyester and the fibres were dyed in the same way as described above, but with a carrier (method 1). Deep blue fibres were again obtained, their colour values being as follows:

$X=15.0$ $Y=12.9$ $Z=31.0.$

The colour values confirm that, when dyed in the absence of a carrier, the fibres produced with an addition of 1% by weight of zeolite are left with the same colour as zeolite-free polyethylene terephthalate fibres dyed in the presence of a carrier.

EXAMPLE 2

80 kg of dimethyl terephthalate and 77 kg of ethylene glycol (molar ratio 1:3) were introduced into an autoclave and reacted for 3 hours at 200° C./normal pressure.

0.8% by weight, based on polyethylene terephthalate, of the silicate charged with dry nitrogen as described in Example 1 was then added. Precondensation was carried out for 30 minutes at 220° C. Polycondensation was subsequently carried out over a period of 2.5 hours at 275° C./<1 Torr, followed by spinning and granulation.

The granulate was delivered to an extruder and processed in the same way as described in Example 1 to form fibres having the following properties:

denier: 1.7 dtex
strength: 3.5 cN/dtex
elongation: 35%.

The fibres obtained were tested for their dyeability as in the same way as in Example 1. After dyeing (method 2, no carrier), the colour values were as follows:

$X=13.2$ $Y=11.9$ $Z=29.3.$

The dyeing test was then carried out on fibres produced in the same way, but without the addition of silicate. The following colour values were obtained using method 1 (with carrier):

$X=13.5$ $Y=12.1$ $Z=29.4.$

The colour values again confirm that, by adding 0.8% by weight of the silicate, it is possible in the absence of a carrier to obtain the same colour as when an unmodified polyester is dyed in the presence of a carrier.

We claim:

1. A process for the production of polyester filaments and fibers which can be dyed in the absence of a carrier which comprises introducing into the polymer to be spun from 0.1 to 4.0% by weight based on the mixture as a whole of a silicate charged with an inert gas, melt spinning the mixture obtained in known manner and further processing into filaments or fibers, wherein said silicate has a three dimensional network and contains channels or vacuoles which can be charged with inert gas.

2. The process of claim 1, wherein said silicate is introduced in an amount of 0.3 to 1% by weight.

3. The process of claim 1, wherein said silicate is a zeolite.

4. The process of claim 1 wherein said silicate charged with inert gas is prepared by heating a silicate containing channels or vacuoles filled with water under vacuum to remove the water and replacing the water by applying the inert gas under slight excess pressure and cooling.

5. The process of claim 1 wherein the filament or fiber produced subjected to the further step of dyeing in the absence of carriers.

6. The dyed filament or fiber prepared by the process of claim 5.

* * * * *